US006001186A

United States Patent [19]

Johnson et al.

[11] Patent Number: 6,001,186

[45] Date of Patent: Dec. 14, 1999

[54] ACID CLEANING/DEOXIDIZING ALUMINUM AND TITANIUM WITHOUT SUBSTANTIAL ETCHING

[75] Inventors: Philip M. Johnson, Southfield; Lawrence R. Carlson, Waterford, both of Mich.

[73] Assignee: Henkel Corporation, Gulph Mills, Pa.

[21] Appl. No.: 09/091,575

[22] PCT Filed: Nov. 25, 1996

[86] PCT No.: PCT/US96/18548

§ 371 Date: Jun. 22, 1998

§ 102(e) Date: Jun. 22, 1998

[87] PCT Pub. No.: WO97/23588

PCT Pub. Date: Jul. 3, 1997

Related U.S. Application Data

[60] Provisional application No. 60/009,094, Dec. 22, 1995.

[51] Int. Cl.[6] ..... B08B 3/08; C23G 1/02; C11D 1/22; C11D 1/62; C11D 1/65

[52] U.S. Cl. ..... 134/3; 134/41; 510/426; 510/492; 510/504; 510/506

[58] Field of Search ..... 134/3, 41, 28; 510/426, 492, 504, 506

[56] References Cited

U.S. PATENT DOCUMENTS

| | | | |
|---|---|---|---|
| 4,116,853 | 9/1978 | Binns | 134/41 X |
| 4,370,173 | 1/1983 | Dollman | 134/3 |
| 5,052,421 | 10/1991 | McMillen | 134/2 |
| 5,393,447 | 2/1995 | Carlson et al. | 134/3 |
| 5,486,316 | 1/1996 | Bershas et al. | 134/3 |
| 5,584,943 | 12/1996 | Banaszak et al. | 134/41 X |

*Primary Examiner*—Frankie L. Stinson
*Assistant Examiner*—Saeed Chaudhry
*Attorney, Agent, or Firm*—Ernest G. Szoke; Wayne C. Jaeschke; Norvell E. Wisdom, Jr.

[57] ABSTRACT

A chromium and ferricyanide free aqueous cleaner/deoxidizer for aluminum and titanium and their alloys contains strong acid, fluoride ions, aryl quaternary ammonium ions, and di-anionic functional substituted compounds containing at least two aryl groups per molecule. Excellent cleaning and deoxidizing with substantially no etching is achieved.

20 Claims, 1 Drawing Sheet

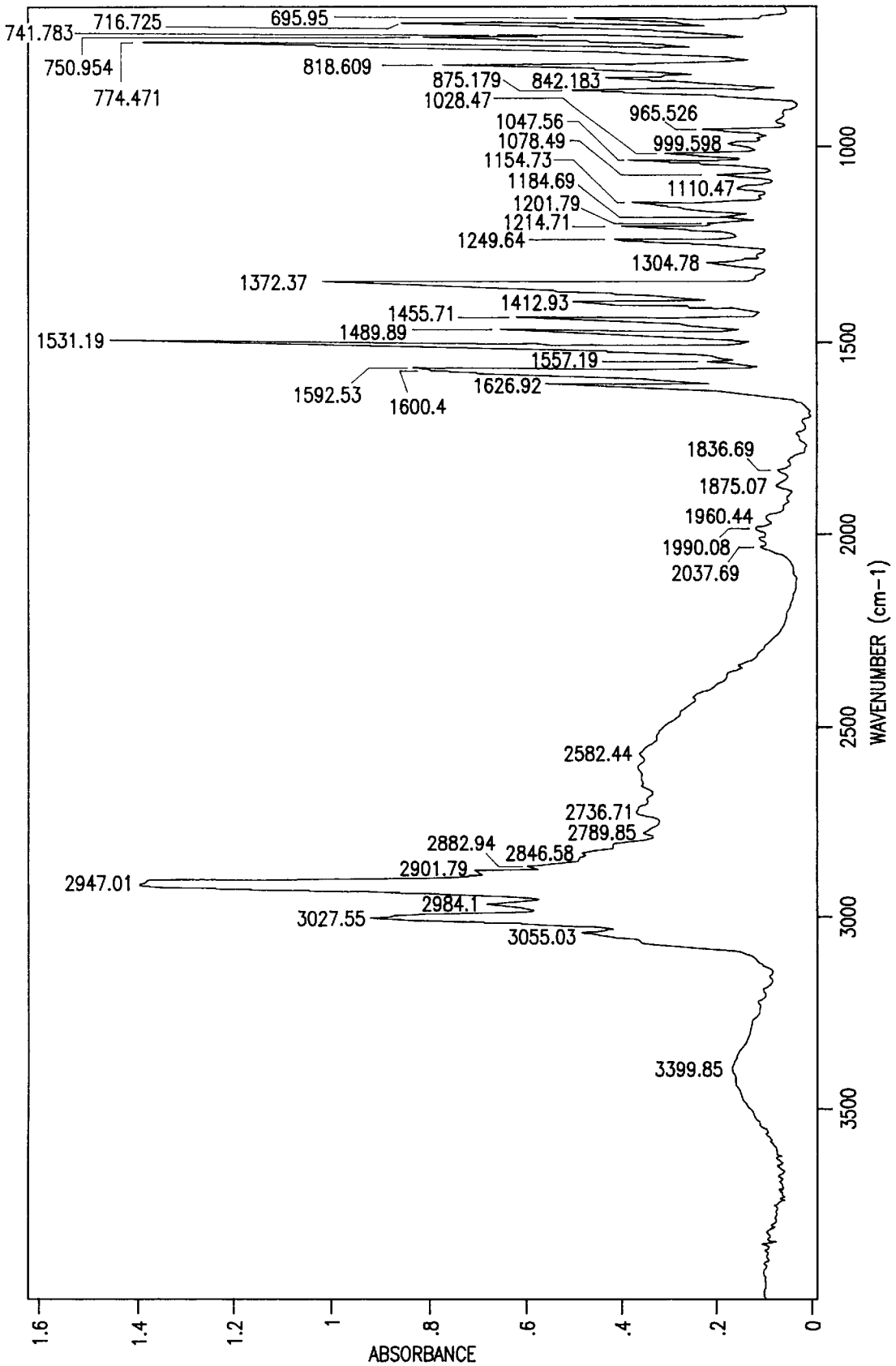
741.783
716.725
695.95
750.954
774.471
818.609
875.179
842.183
1028.47
965.526
1047.56
999.598
1078.49
1154.73
1184.69
1110.47
1201.79
1214.71
1249.64
1304.78
1372.37
1412.93
1455.71
1489.89
1531.19
1557.19
1592.53
1600.4
1626.92
1836.69
1875.07
1960.44
1990.08
2037.69
2582.44
2736.71
2789.85
2882.94
2846.58
2901.79
2947.01
2984.1
3027.55
3055.03
3399.85
1000
1500
2000
2500
3000
3500
WAVENUMBER (cm-1)
1.6
1.4
1.2
1
.8
.6
.4
.2
0
ABSORBANCE

ACID CLEANING/DEOXIDIZING ALUMINUM AND TITANIUM WITHOUT SUBSTANTIAL ETCHING

CROSS REFERENCE TO RELATED APPLICATION

Priority for this application from provisional application Ser. No. 60/009,094 filed Dec. 22, 1995 is claimed under 35 U.S.C. § 119(e).

BACKGROUND OF THE INVENTION

1. Field of the Invention

This invention relates to inhibitors, compositions, and processes for deoxidizing and/or cleaning surfaces of aluminum and titanium and their alloys that contain at least 45% by weight of aluminum or titanium. "Deoxidizing" is to be understood herein as the removal from the surface of metals of oxide films and other adherent inorganic materials that would reduce adhesion to subsequently applied protective coatings such as conversion coatings and/or paints and the like, and "cleaning" means removal of all other foreign materials, especially organic soils and poorly adherent inorganic substances such as metal dust and the like, that would reduce adhesion to such subsequently applied protective coatings.

2. Statement of Related Art

With most deoxidizing agents, especially acidic aqueous liquid compositions with substantial free fluoride ion activity, which are probably the most effective chemical class of cleaners and deoxidizers for aluminum and titanium now known, there is a perceptible but controlled etching or dissolution of the underlying aluminum or titanium while the deoxidizing agent is in contact with it. Such etching is often harmless or even desirable, as when it improves the smoothness of the metal surface being treated. In some instances, however, particularly where very narrow dimensional tolerances on the substrate need to be maintained, effective cleaning and deoxidizing with little or no etching is desirable, but heretofore has been very difficult to obtain.

DESCRIPTION OF THE INVENTION

Object of the Invention

The primary object of the invention is to provide compositions and processes for cleaning and/or deoxidizing metal surfaces with little or no etching. Other objects will be apparent from the description below.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counter-ions to produce electrical neutrality for the composition as a whole, and any counterions thus implicitly specified should preferably be selected from among other constituents explicitly specified in ionic form, to the extent possible; otherwise such counterions may be freely selected, except for avoiding counterions that act adversely to the objects of the invention; the term "mole" means "gram mole", and "mole" and its grammatical variations may be applied herein, *mutatis mutandis*, to ionic or any other chemical species with defined numbers and types of atoms, as well as to chemical substances with well defined conventional molecules.

SUMMARY OF THE INVENTION

It has been found that a combination of quaternary aryl ammonium salts and di-anionic functional substituted compounds containing at least two aryl moieties have a synergistic effect when present together in acidic fluoride containing aqueous liquid compositions, so that such compositions are substantially as effective in cleaning and deoxidizing aluminum and titanium substrates as are previously known acidic fluoride containing aqueous liquid compositions without the quaternary ammonium salts or di-anionic functional substituted compounds containing at least two aryl moieties, but have much lower rates of dissolving the underlying substrate metals than do the previously known acid fluoride containing aqueous liquid compositions without these two synergistic inhibitor additives and do not leave objectionable films on the metal surfaces treated.

Accordingly, one embodiment of the invention is an aqueous liquid composition that comprises, preferably consists essentially of, or more preferably consists of, water and:

(A) a component of dissolved acid with a larger ionization constant in water than hydrofluoric acid;

(B) a component of dissolved fluorine containing anions;

(C) a component of dissolved aryl moiety containing[1] quaternary ammonium salts; and (D) a component of dissolved organic compounds corresponding to the general formula:

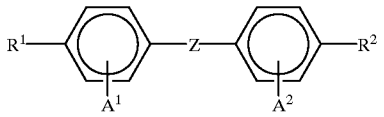

wherein each of $R^1$ and $R^2$, which may be the same or different, is selected from the group consisting of aliphatic and monovalent hydrocarbon, halocarbon, halohydrocarbon, alkoxy substituted hydrocarbon, and alkoxy substituted halohydrocarbon moieties; each of $A^1$ and $A^2$, which may be the same or different, is selected from the group consisting of sulfonate, carboxylate, and phosphonate anions and the corresponding unionized acids; and Z is a divalent moiety selected from the group consisting of O, $CR^3R^4$, S, $NR^5$, and $PR^6$, wherein each of $R^3$, $R^4$, and $R^5$, which may be the same or different, is selected from the group of monovalent moieties consisting of hydrogen, hydrocarbon, halocarbon, halohydrocarbon, and alkoxy substituted hydrocarbon, halocarbon, and halohydrocarbon moieties; and, optionally, one or more of the following:

(E) a component of wetting agent that is not part of any of the preceding components; and (F) a component of dissolved aluminum cations.

[1]The term "aryl moiety" is to be understood as including moieties with rings including heteroatoms such as nitrogen, sulfur, and oxygen when such rings chemically behave similarly to all-carbon aromatic ring moieties such as phenyl and naphthyl. Also, the only quaternary nitrogen atom in the molecule may be part of such a heteroatom containing aromatic ring, or the only quaternary nitrogen atom may be bonded to a complete aromatic ring.

Various other embodiments of the invention include: (i) an inhibitor comprising, preferably consisting essentially of, or more preferably consisting of components (C) and (D) as described above; (ii) working compositions for direct use in treating metals, concentrates and partial concentrates from which such working compositions can be prepared by dilution with water and/or mixing with other chemically distinct concentrates, processes for cleaning and/or deoxidizing metals with a composition according to the invention, and extended processes including additional steps that are conventional per se, such as rinsing, conversion coating, painting, or the like. Articles of manufacture including surfaces treated according to a process of the invention are also within the scope of the invention.

BRIEF DESCRIPTION OF THE DRAWING

The sole drawing FIGURE is an infra-red spectrum of a highly preferred and commercially available type of aryl quaternary ammonium salt containing material for component (C) of a composition according to the invention as described above.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium, ferricyanide, silica; silicates; thiourea; pyrazole compounds; sugars; gluconic acid and its salts; glycerine; α-glucoheptanoic acid and its salts; and myoinositol phosphate esters and salts thereof.

Furthermore, in a process according to the invention that includes other steps than a cleaning and/or deoxidizing treatment with a composition as described above, when avoidance of environmental pollution is an important consideration, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. On the other hand, the cleaning and/or deoxidizing process taught herein can be advantageously used prior to chromate conversion coating or anodizing in a chromate containing—or, of course, a non chromate containing—solution, where one of these types of treatment is needed.

Strong acid component (A) is preferably supplied by sulfuric acid, which is assumed for calculations of the hydrogen/hydronium ions concentration to ionize completely, thus yielding two hydrogen/hydronium ions per molecule. In a working composition according to the invention, the concentration of free hydrogen/hydronium ions preferably is at least, with increasing preference in the order given, 0.001, 0.002, 0.005, 0.008, 0.015, 0.030, 0.040, 0.050, 0.060, 0.070, or 0.074 moles per kilogram of total composition (hereinafter usually abbreviated as "M/kg") and independently preferably is not more than, with increasing preference in the order given, 1.0, 0.9, 0.8, 0.7, 0.6, 0.5, 0.4, 0.30, 0.25, 0.20, 0.17, 0.15, 0.13, 0.11, 0.090, 0.080, or 0.076 M/kg.

Fluoride component (B) preferably is derived from the group consisting of hydrofluoric acid and the total and partial salts thereof, for example sodium fluoride and ammonium bifluoride. None of these materials, even if nominally acidic, is considered for purposes of calculating the concentration of free hydrogen/hydronium ions provided by component (A), because by definition constituents of component (A) are all stronger acids than HF and are assumed to repress its ionization.

Because of the competing complex-forming-and-dissociating equilibria in which fluoride can participate in a working aqueous liquid composition according to this invention that contains hydrofluoric acid and/or polyvalent cations such as aluminum and titanium that can form complex fluometallate anions, the preferable concentrations for fluoride in such a composition are specified in terms of "active free fluoride", as measured by means of a fluoride sensitive electrode and associated instrumentation and methods that are known to those skilled in the art. Suitable apparatus and instructions for using it are commercially available from the Parker Amchem Division ("PAM") of Henkel Corp., Madison Heights, Mich.

"Active free fluoride" as this term is used herein was measured relative to a 120E Activity Standard Solution also commercially available from PAM, using a fluoride sensitive electrode commercially available from Orion Instruments. The electrical potential developed between the fluoride sensitive electrode immersed in the Standard Solution at ambient temperature and a standard reference electrode, e.g., a saturated calomel electrode, is measured with a high impedance millivolt meter. The same fluoride sensitive electrode is then well rinsed, carefully dried by wiping with absorbent paper, and immersed in a sample of a composition according to this invention at ambient temperature, and the potential developed between this fluoride sensitive electrode and the same standard reference electrode as before is then measured. The value obtained with the fluoride sensitive electrode immersed in the Standard Solution is subtracted from the value obtained with the fluoride sensitive electrode immersed in the composition according to the invention to yield the values in millivolt(s) (hereinafter often abbreviated "mv" or "mV") by which the Active Free Fluoride of compositions according to the invention is measured and reported below.

Preferred Active Free Fluoride values for working compositions according to the invention correspond to millivolt values that are negative with respect to the standard solution. Therefore, numbers with higher absolute values are smaller than other negative numbers with lesser absolute values. In a working composition according to the invention, the mv value preferably is not greater than, with increasing preference in the order given, −20, −30, −40, −50, −60, −70, −80, −85, −90, −95, or −98 and independently preferably is at least −150, −140, −130, −120, −115, −110, −105, or −100. (When the fluoride is supplied entirely by hydrofluoric acid and other constituents have their preferred values, the preferred mv values of the working compositions according to the invention can be obtained by the presence of 0.9–1.1 grams per kilogram of total composition {hereinafter usually abbreviated as "g/kg"} of hydrofluoric acid.)

Aryl quaternary ammonium salt component (C) preferably has a concentration in a working composition according to the invention that is at least, with increasing preference in the order given, 0.5, 1.0, 1.5, 2.0, 2.5, 3.0, 3.5, 4.0, 4.5, or 4.9 g/kg and independently preferably is, primarily for reasons of economy, not more than 25, 20, 15, 11, 10, 9, 8.0, 7.5, 7.0, 6.5, 6.0, 5.5, or 5.1 g/kg.

The most preferred material for component (C) is a commercially supplied product, DODICOR™ V2565, from Hoechst Celanese Corp., which is reported by its supplier to be a solution in water of an aryl quaternary ammonium salt, with a chemical nature otherwise proprietary. An infra-red spectrum of the material extracted with $CCl_4$ from this commercial product, then dried and pelletized with KBr, is shown in the sole drawing FIGURE.

The concentration of component (D) in a working composition according to the invention preferably is at least, with increasing preference in the order given, 1.0, 1.5, 2.0, 2.5, 3.0, 3.5, 4.0, 4.5, 5.0, 5.5, or 5.9 g/kg and independently preferably is not more than 30, 25, 20, 15, 11, 10, 9, 8.0, 7.5, 7.0, 6.5, or 6.1 g/kg. These upper limits are preferred not only for reasons of economy but because higher amounts of component (D) can lead to deposition of films on the surface being treated, as evidenced by weight gain instead of loss on test panels immersed in solutions that, but for the presence of components (C) and (D), would be expected to etch the substrates fairly rapidly.

Primarily for reasons of economy, it is preferred that constituents of component (D) be selected from molecules conforming to the general formula given above when each of $R^1$ and $R^2$, independently, is selected from unsubstituted aliphatic hydrocarbon moieties. Independently, for reasons of both economy and effectiveness, it is preferred that each of $A^1$ and $A^2$ be sulfonate, and also independently that Z be an oxygen atom. An especially preferred material for component (D) is a commercial product known as DOWFAX™ 2A1, which is available from Dow Chemical Co. and is reported by its supplier to be the disodium salt of a disulfonic acid having the chemical structure shown in the general formula for component (D) above when Z is an oxygen atom, each of $A^1$ and $A^2$ is sulfonate, and each of $R^1$ and $R^2$ is a moiety having twelve carbon atoms with a structure that, except for the addition of one hydrogen atom, is derivable by oligomerizing four molecules of propylene.

Normally the presence of optional auxiliary wetting agent component (E) in compositions according to the invention is preferable. A particularly preferred material for this component is MIRANATE™ B, a commercial product of Rhône-Poulenc that is reported by its supplier to contain 32% of sodium butoxyethoxyacetate and 11% of butoxyethanol, with the balance water. When this material is present in working compositions according to the invention, the concentration preferably is such as to supply at least, with increasing preference in the order given, 0.10, 0.20, 0.30, 0.40, 0.50, or 0.60 g/kg, and independently preferably, primarily for reasons of economy, not more than 5, 4, 3, 2.0, 1.0, 0.90, 0.80, or 0.70 g/kg, of sodium butoxyethoxyacetate.

Optional component (F) of dissolved aluminum cations is normally included from the beginning in a freshly prepared working composition according to the invention that is to be used on aluminum substrates, because if it is omitted, the initial cleaning rate may be too slow to be satisfactory and then increase substantially as aluminum dissolves from the substrates into the working composition during use. Accordingly, a working composition according to the invention normally preferably contains from the beginning at least, with increasing preference in the order given, 0.05, 0.08, 0.11, 0.14, 0.17, or 0.19 g/kg of dissolved aluminum cations, unless the working composition is intended for use on titanium only. In the latter case, there is no particular preference for any content of optional component (F).

A process according to the invention is normally preferably performed at normal ambient temperatures from about 15 to 30° C., because the cleaning action is generally completed within a satisfactorily short time at this temperature and no special energy cost for maintaining the process temperature is incurred. However, any temperature between the freezing and boiling points of the composition according to the invention used in the process may alternatively be used.

The practice of this invention may be further appreciated by consideration of the following, non-limiting, working examples, and the benefits of the invention may be further appreciated by consideration of the comparison examples.

EXAMPLES AND COMPARISON EXAMPLES

A base cleaner concentrate of the following composition was prepared: 7.35% of $H_2SO_4$; 1.89% of HF; an amount of aluminum sulfate to correspond to 0.395% of $Al^{+3}$ ions; 4.0% of MIRANATE™ B; and the balance of water. Working compositions containing 5.0% of this base composition and other ingredient(s) as shown in Table 1 below were prepared and tested for the extent of weight loss from square panels of titanium and/or aluminum 5.08 centimeters on each side after 10 minutes immersion at normal ambient temperature (i.e., 20–25° C.) in the compositions. The weight loss values are also shown in Table 1.

TABLE 1

EFFECT OF CANDIDATE INHIBITORS ON TITANIUM AND ALUMINUM DISSOLUTION

| Inhibitor Ingredient(s) and Amount(s) | Active Free Fluoride, mV | Loss in Grams After 10 Minutes From Ti | Loss in Grams After 10 Minutes From Al |
|---|---|---|---|
| 5 g/L of HOSTACOT ™ 2445 | −99 | 0.024 | n.m. |
| 5 g/L of HOSTACOR ™ 2732 | −99 | 0.025 | n.m. |
| 2.5 g/L of RODINE ® 31A | −99 | 0.0245 | n.m. |
| 5.0 g/L of DODICOR ™ V 2565 | −99 | 0.0032 | n.m. |
| None | −102 | 0.0219 | n.m. |
| 0.5 g/L of DODICOR ™ V 2565 | n.m. | 0.0166 | n.m. |
| 2.5 g/L of DODICOR ™ V 2565 | −102 | 0.0005 | n.m. |
| 5.0 g/L of DODICOR ™ V 2565 | −102 | 0.001 | n.m. |

TABLE 1-continued

EFFECT OF CANDIDATE INHIBITORS ON TITANIUM AND ALUMINUM DISSOLUTION

| Inhibitor Ingredient(s) and Amount(s) | Active Free Fluoride, mV | Loss in Grams After 10 Minutes From Ti | Loss in Grams After 10 Minutes From Al |
|---|---|---|---|
| 10.0 g/L of DODICOR ™ V 2565 | −102 | 0.0005 | n.m. |
| 15.0 g/L of DODICOR ™ V 2565 | −102 | 0.0003 | n.m. |
| None[1] | −95 | 0.0187 | n.m. |
| 2.5 g/L of DODICOR ™ V 2565[1] | −95 | 0.0026 | Note[2] |
| 5.0 g/L of DODICOR ™ V 2565[1] | −95 | 0.0015 | Note[2] |
| 10.0 g/L of DODICOR ™ V 2565[1] | −95 | 0.0005 | Note[2] |
| 15.0 g/L of DODICOR ™ V 2565[1] | −95 | 0.0008 | Note[2] |
| None | −105 to −104 | n.m. | >0.02 |
| 2.0 g/L of DODICOR ™ V 2565 and 10.0 g/L of DOWFAX ™ 2A1 | −105 to −104 | 0.0079 | 0.0068 |
| 2.5 g/L of DODICOR ™ V 2565 and 10.0 g/L of DOWFAX ™ 2A1 | −105 to −104 | >0.007 | 0.007 |
| 5.0 g/L of DODICOR ™ V 2565 and 2.0 g/L of DOWFAX ™ 2A1 | −105 to −104 | n.m. | gain[2] |
| 5.0 g/L of DODICOR ™ V 2565 and 4.0 g/L of DOWFAX ™ 2A1 | −105 to −104 | n.m. | gain[2] |
| 5.0 g/L of DODICOR ™ V 2565 and 6.0 g/L of DOWFAX ™ 2A1 | −105 to −104 | 0.0023 | 0.0002 |
| 5.0 g/L of DODICOR ™ V 2565 and 8.0 g/L of DOWFAX ™ 2A1 | −105 to −104 | 0.0023 | 0.0013 |
| 5.0 g/L of DODICOR ™ V 2565 and 10.0 g/L of DOWFAX ™ 2A1 | −105 to −104 | 0.0029 | 0.0018 |

Footnotes for Table 1

[1]In these working compositions, the aluminum concentration had been increased to 1.2 g/L.

[2]Aluminum panels exhibited a visible colored film, believed to be aluminum fluoride stained with the DODICOR ™ V 2565 material, after immersion treatment.

Other Notes for Table 1

HOSTACOR ™ 2445 and 2732 inhibitors are commercial products of Hoechst Celanese Corp. and are reported by their supplier to be "a condensation product of boron and carboxylic acid" and "alkylamido carboxylic acid" respectively.

RODINE ® 31A pickling inhibitor is a commercial product of PAM with rosin amines as its principal active ingredients.

"n.m." means "not measured".

The results in Table 1 show that the aryl quaternary ammonium salt type inhibitor is far more effective in inhibiting the dissolution of titanium in the acidic fluoride containing cleaning solutions tested than any of the other types of inhibitors. However, the aryl quaternary ammonium salt inhibitor not only also inhibits the dissolution of aluminum but forms a colored film on its surface, so that cleaners containing only this inhibitor are not satisfactory for cleaning aluminum, although they are effective for titanium.

When an auxiliary inhibitor according to the general formula given above is added to the acidic fluoride cleaning solution, the discoloration of aluminum is eliminated, while the dissolution of titanium and aluminum is still very effectively inhibited. Thus this combination according to the invention provides an almost ideal non-etching cleaner.

The invention claimed is:

1. An etching inhibitor combination for liquid compositions for cleaning, deoxidizing, or both cleaning and deoxidizing aluminum, titanium, or both aluminum and titanium, said inhibitor combination consisting essentially of (i) quaternary ammonium salts that contain aryl moieties and (ii) dissolved organic compounds corresponding to the general formula:

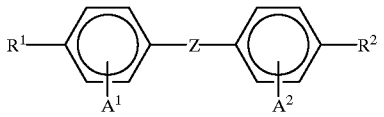

wherein each of $R^1$ and $R^2$, which may be the same or different, is selected from the group consisting of aliphatic and monovalent hydrocarbon, halocarbon, halohydrocarbon, alkoxy substituted hydrocarbon, and alkoxy substituted halohydrocarbon moieties; each of $A^1$ and $A^2$, which may be the same or different, is selected from the group consisting of sulfonate, carboxylate, and phosphonate anions and the corresponding unionized acids; and Z is a divalent moiety selected from the group consisting of O, $CR^3R^4$, S, $NR^5$, and $PR^6$, wherein each of $R^3$, $R^4$, and $R^5$, which may be the same or different, is selected from the group of monovalent moieties consisting of hydrogen, hydrocarbon, halocarbon, halohydrocarbon, and alkoxy substituted hydrocarbon, halocarbon, and halohydrocarbon moieties.

2. An etching inhibitor combination according to claim 1, wherein, in the general formula, each of $R^1$ and $R^2$ represents an unsubstituted aliphatic hydrocarbon moiety, each of $A^1$ and $A^2$ represents a sulfonate moiety, and Z represents an oxygen atom.

3. An etching inhibitor combination according to claim 2, wherein component (i) has an infrared spectrum as shown in the sole drawing FIGURE.

4. An etching inhibitor combination according to claim 1, wherein component (i) has an infrared spectrum as shown in the sole drawing FIGURE.

5. An aqueous liquid composition suitable for cleaning and deoxidizing aluminum and titanium without substantially etching the metal cleaned and deoxidized, said aqueous liquid composition comprising water and:

A) a component of dissolved acid with a larger ionization constant in water than hydrofluoric acid;

(B) a component of dissolved fluorine containing anions;

(C) a component of dissolved aryl moiety containing quaternary ammonium salts; and (D) a component of dissolved organic compounds corresponding to the general formula:

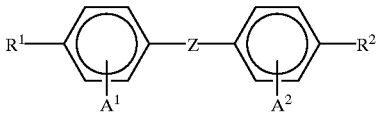

wherein each of $R^1$ and $R^2$, which may be the same or different, is selected from the group consisting of aliphatic and monovalent hydrocarbon, halocarbon, halohydrocarbon, alkoxy substituted hydrocarbon, and alkoxy substituted halohydrocarbon moieties; each of $A^1$ and $A^2$, which may be the same or different, is selected from the group consisting of sulfonate, carboxylate, and phosphonate anions and the corresponding unionized acids; and Z is a divalent moiety selected from the group consisting of O, $CR^3R^4$, S, $NR^5$, and $PR^6$, wherein each of $R^3$, $R^4$, and $R^5$, which may be the same or different, is selected from the group of monovalent moieties consisting of hydrogen, hydrocarbon, halocarbon, halohydrocarbon, and alkoxy substituted hydrocarbon, halocarbon, and halohydrocarbon moieties.

6. A composition according to claim 5, wherein component (A) is present in an amount, measured as hydrated protons, from about 0.005 to about 0.5 M/kg, the composition has an Active Free Fluoride value from about −150 to about −20 mv, component (C) is present in an amount from about 0.5 to about 25 g/kg, and component (D) is present in an amount from about 1.0 to about 30 g/kg.

7. A composition according to claim 6, wherein component (A) is present in an amount from about 0.015 to about 0.30 M/kg, the composition has an Active Free Fluoride value from about −130 to about −50 mv, component (C) is present in an amount from about 1.5 to about 10 g/kg, and component (D) is present in an amount from about 2.5 to about 15 g/kg.

8. A composition according to claim 6, wherein component (A) is present in an amount from about 0.050 to about 0.13 M/kg, the composition has an Active Free Fluoride value from about −110 to about −90 mv, component (C) is present in an amount from about 3.0 to about 8.0 g/kg, and component (D) is present in an amount from about 4.0 to about 8.0 g/kg.

9. A composition according to claim 8, wherein: component (A) is sulfuric acid; component (B) is selected from the group consisting of hydrofluoric and totally and partially neutralized salts of hydrofluoric acid; component (C) has an infrared spectrum corresponding to the sole drawing FIGURE; component (D) corresponds to said general formula when each of $R^1$ and $R^2$ represents an unsubstituted aliphatic hydrocarbon moiety, each of $A^1$ and $A^2$ represents a sulfonate moiety, and Z represents an oxygen atom; and the composition also comprises from about 0.40 to about 4.0 g/kg of sodium butoxyethoxy-acetate.

10. A composition according to claim 7, wherein: component (A) is sulfuric acid; component (B) is selected from the group consisting of hydrofluoric and totally and partially neutralized salts of hydrofluoric acid; component (C) has an infrared spectrum corresponding to the sole drawing FIGURE; and component (D) corresponds to said general formula when each of $R^1$ and $R^2$ represents an unsubstituted aliphatic hydrocarbon moiety, each of $A^1$ and $A^2$ represents a sulfonate moiety, and Z represents an oxygen atom.

11. A composition according to claim 6, wherein: component (A) is sulfuric acid; component (B) is selected from the group consisting of hydrofluoric and totally and partially neutralized salts of hydrofluoric acid; component (C) has an infrared spectrum corresponding to the sole drawing FIGURE; and component (D) corresponds to said general formula when each of $R^1$ and $R^2$ represents an unsubstituted aliphatic hydrocarbon moiety, each of $A^1$ and $A^2$ represents a sulfonate moiety, and Z represents an oxygen atom.

12. A composition according to claim 5, wherein: component (A) is sulfuric acid; component (B) is selected from the group consisting of hydrofluoric and totally and partially neutralized salts of hydrofluoric acid; component (C) has an infrared spectrum corresponding to the sole drawing FIGURE; and component (D) corresponds to said general formula when each of $R^1$ and $R^2$ represents an unsubstituted aliphatic hydrocarbon moiety, each of $A^1$ and $A^2$ represents a sulfonate moiety, and Z represents an oxygen atom.

13. A process for deoxidizing, cleaning, or both cleaning and deoxidizing a surface including at least 45% by weight of aluminum or titanium, said process comprising contacting the surface with a composition according to claim 12 that, if the surface includes a portion that contains at least 45% by weight of aluminum, also comprises at least about 0.14 g/kg of aluminum cations.

14. A process for deoxidizing, cleaning, or both cleaning and deoxidizing a surface including at least 45% by weight of aluminum or titanium, said process comprising contacting the surface with a composition according to claim 11.

15. A process for deoxidizing, cleaning, or both cleaning and deoxidizing a surface including at least 45% by weight of aluminum or titanium, said process comprising contacting the surface with a composition according to claim 10.

16. A process for deoxidizing, cleaning, or both cleaning and deoxidizing a surface including at least 45% by weight of aluminum or titanium, said process comprising contacting the surface with a composition according to claim 9.

17. A process for deoxidizing, cleaning, or both cleaning and deoxidizing a surface including at least 45% by weight of aluminum or titanium, said process comprising contacting the surface with a composition according to claim 8.

18. A process for deoxidizing, cleaning, or both cleaning and deoxidizing a surface including at least 45% by weight of aluminum or titanium, said process comprising contacting the surface with a composition according to claim 7.

19. A process for deoxidizing, cleaning, or both cleaning and deoxidizing a surface including at least 45% by weight of aluminum or titanium, said process comprising contacting the surface with a composition according to claim 6.

20. A process for deoxidizing, cleaning, or both cleaning and deoxidizing a surface including at least 45% by weight of aluminum or titanium, said process comprising contacting the surface with a composition according to claim 5.

* * * * *